US005544848A

United States Patent [19]

Kuhn et al.

[11] Patent Number: 5,544,848

[45] Date of Patent: Aug. 13, 1996

[54] RAILROAD SPRING FROG

[75] Inventors: Stephen R. Kuhn, Richton Park; Keith Young, Naperville, both of Ill.

[73] Assignee: ABC Rail Products Corporation, Chicago, Ill.

[21] Appl. No.: 384,026

[22] Filed: Feb. 6, 1995

[51] Int. Cl.[6] ..... B61L 11/00

[52] U.S. Cl. ..... 246/276; 246/468

[58] Field of Search ..... 246/276, 275, 246/454, 458, 468, 469, 470, 471, 472

[56] References Cited

U.S. PATENT DOCUMENTS 930,709 8/1909 Whiteman ..... 246/276
1,577,672 3/1926 Almquist ..... 246/276
2,129,734 9/1938 Gerlach ..... 246/276
2,174,367 9/1939 Hoffman ..... 246/276
4,624,428 11/1986 Frank ..... 246/276

*Primary Examiner*—Mark Tuan Le
*Attorney, Agent, or Firm*—Thomas S. Baker, Jr.

[57] ABSTRACT

An improved railroad trackwork frog is provided with a relatively fixed rigid wing rail, a relatively movable spring wing rail, a base plate, and at least one roller outrigger and ramp plate assembly which is attached to the spring wing rail and to the base plate, and which functions to cause limited upwards vertical movement of the spring wing rail relative to the base plate when the spring wing rail is moved laterally relative to the rigid wing rail by the engaged wheel flange of a passing rail car.

5 Claims, 3 Drawing Sheets

RAILROAD SPRING FROG

FIELD OF THE INVENTION

This invention relates generally to railroad trackwork, and particularly concerns an improved frog of the spring-rail type which is principally used at turn-outs from main line track.

BACKGROUND OF THE INVENTION

A railroad frog is a device which is installed at the intersection of two running rails to permit the flanges of railroad car wheels moving along one of the rails to pass across the other rail. The frog supports the car wheels as they pass over the missing rail tread surface between the throat and the point of the frog, and also provides flangeways for the flanges of those car wheels which pass through the frog.

As described in the specification of U.S. Pat. No. 4,624,428, issued in the name of Frank and assigned to the assignee of this application, a standard railroad spring frog includes a rigid wing rail, which is substantially aligned with a long point or heel rail connected to a turnout traffic rail, and a relatively movable wing rail which is substantially aligned with a short point or heel rail that is connected to a main line traffic rail. The movable wing rail is mounted with a yieldable free end, is often spring-biased against the frog long point rail by additional spring means, and provides a substantially continuous support for the wheels of a rail car passing along the main line track. The movable wing rail, sometimes called a spring wing rail, is moved laterally away from the long point rail to provide a wheel flangeway between the long point rail and the spring wing rail when a car wheel flange traversing the long point or rigid wing rail engages the spring wing rail free end and forces or causes it to move laterally to a full open position.

Heretofore, such standard railroad trackwork frogs have utilized conventional horn/horn-holddown assemblies to limit spring wing rail vertical movement when the rail is moved sideways by action of passing car wheel flanges. Such conventional assemblies utilize: (1) sliding-type horn elements that are connected to and project laterally from the spring wing rail, and (2) horn holddown elements that are fastened to a frog base plate, that house riser block elements, and that slidably co-operate with and vertically restrain the sliding-type horn elements. However, it has long been observed that the conventional horn/horn-holddown assemblies are susceptible to excessive abrasive wear at the upper surfaces of the riser block elements and at the upper surfaces of the slide horn elements due to the inherent longitudinal twisting action of the spring wing rail which results as it is moved by flange-originated forces applied laterally to the upper portion of the rail. Also, spring wing rail lateral displacements and longitudinal twisting actions repeatedly effected as a result of wheel-flange forces result in excessive abrasion of the frog base plate element by the lower portion of the spring wing rail at its point of roll-over.

I have invented a new and useful railroad trackwork frog construction, including a new and useful spring wing rail attached roller outrigger subassembly with a co-operating ramp-like roller support, that overcomes the noted deficiencies associated with the prior art railroad trackwork frog conventional construction using slide-type horn/horn-holddown assemblies to effect limited spring wing rail vertical movement. Other objects and advantages of the present discovery will become apparent during a careful consideration of the invention summary, description of the drawings, and detailed description which follow.

SUMMARY OF THE INVENTION

The improved railroad trackwork frog of this invention is essentially comprised of a base plate element, a fixed wing rail element mounted to the base plate element, a movable wing rail element mounted to the base plate element and having a yieldable, free end portion, and one or more combined roller outrigger and riser plate elements which are each rigidly connected to the base plate element and to the movable wing rail element and which each function to permit limited vertical displacement of the movable wing rail with minimum rail twisting as the rail is moved laterally by its engagement with the flanges of rail car wheels passing through the frog.

In addition, the improved railroad trackwork frog of this invention may advantageously include a spring box element which is connected to the base plate element and which functions to positively return the movable wing rail to its initial full closed position after co-operating car wheel have passed through the frog. Also, the frog construction may advantageously further include one or more novel roller holddown elements which are usually connected to the base plate element at positions near the roller outrigger and riser plate combination elements and which function to limit vertical displacement of portions of the spring wing rail.

DETAILED DESCRIPTION

Figure 1:
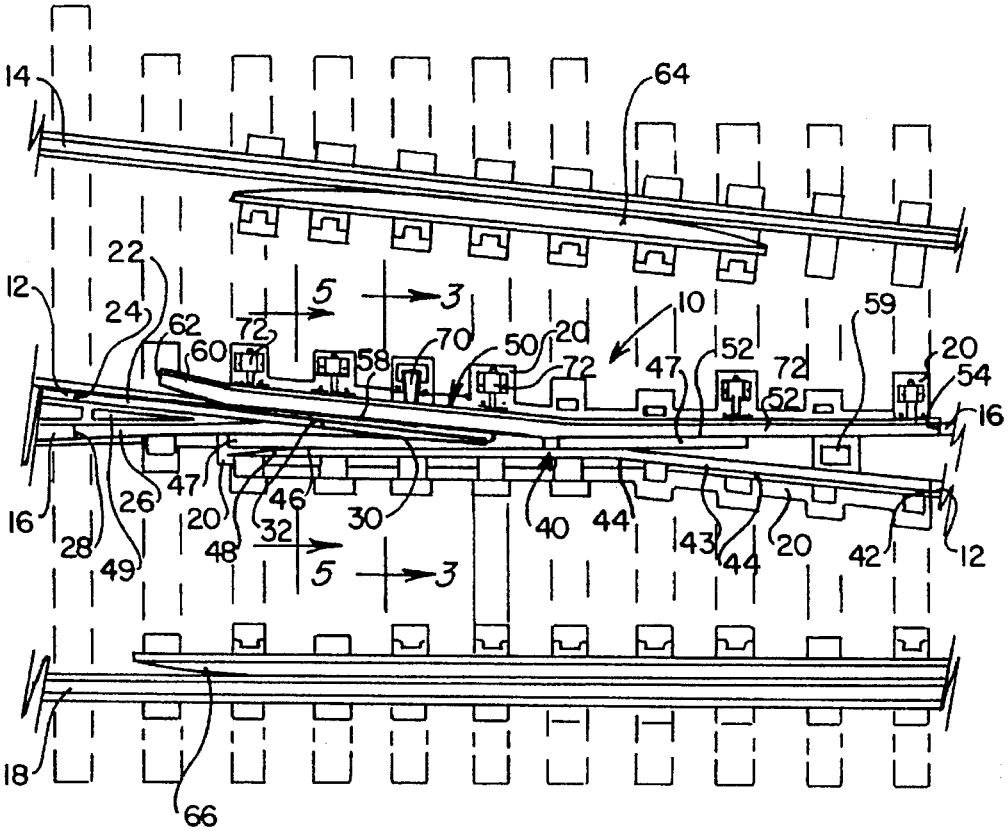
FIG. 1 is a plan view of a preferred embodiment of the improved railroad track spring frog of this invention.

Referring to FIG. 1, a right-hand spring frog assembly 10 is shown inserted in one rail 12 of a pair of turnout rails 12, 14 and one rail 16 of a pair of mainline rails 16, 18. Spring frog 10 is assembled and mounted on a base plate element 20 which provides a level foundation for the frog and which maintains the elements which comprise the frog in their proper relationship during assembly, shipping, and subsequent installation in a railroad trackwork. Frog assembly 10 is functionally positioned to permit flanged rail car wheels riding along rail 12 to cross rail 16 and flanged rail car wheels riding along rail 16 to cross rail 12. A conventional switch stand for directing rail cars from rail pair 12, 14 to rail pair 16, 18 and vice versa is necessary for the trackwork but does not comprise a portion of frog assembly 10.

A long point rail element 22 is mounted on base plate 20 at the heel end of frog assembly 10 and has a rail end 24 which upon frog installation is joined, as by welding, to turnout line rail 12 to provide a connection for that rail to frog assembly 10. A short point rail 26 is also mounted on base plate 20 and has a rail end 28 which upon frog installation is joined, as by welding, to mainline rail 16 to connect that rail to frog assembly 10. Long point rail element 22 and short point rail element 26 are mounted on base plate element 20 at an included angle relative to each other which is known as the angle of frog. A heel block element 49 may be bolted into position with and between point rail elements 22 and 26 to maintain the desired angle and spacing between such point rail elements, and also a heel riser element (not illustrated) may be provided to protect the point rails from damage due to car wheels having false flanges. See U.S. Pat. No. 4,362,282 for a description of the false flange protection problem. Long point rail element 22 terminates with a tapered vertical surface 30 on one side which is substantially parallel with mainline rail 16, and short point rail element 26 terminates with a tapered vertical surface 32 on one side which is substantially parallel with turnout rail 12. Surface 32 is complementary to and engages one side of long point rail 22. The pointed end of long rail element 22 terminates with a width of approximately one-half inch and is known as the half inch point of the frog assembly.

The generally-curved, fixed wing rail element 40 of frog assembly 10 has an end 42 connected to a curved closure rail section 43, has a long body section 44, and has a joined, angled body section 46 that is oriented generally parallel to short point rail element 26. Upon installation, closure rail section 43 is joined at its end 42 to a section of turnout rail 12. The end 48 of wing rail element 40 is preferably flared so that the flange of a car wheel moving along short point rail element 26 toward element 40 will not strike the wing rail free end. An elongated inter-rail spacer or filler 47 is positioned intermediate and joined to the web portions of short-point rail 26 and fixed wing rail end portion 46 and also intermediate and joined to the web portions of long-point rail 24 and rail end portion 46 and functions to establish a continuously open flangeway between those rails principally to accommodate the car wheel flanges of rail cars passing through frog assembly 10 on mainline tracks 16 and 18. The rigid wing rail element 40 is rigidly secured to base plate element 20 by conventional means such as plate clips and is a relatively immovable member of frog assembly 10.

The yieldably-mounted spring wing rail element 50, which is the primary movable member of frog assembly 10, has a straight, long body section 52 which terminates at an end 54 that upon installation is joined to a section of mainline rail 16. Element 50 also has an angled body section 58 which is at the opposite end of long body section 52. Angled body section 58 is parallel to and engages the side of long point rail 22 opposite that engaged by short point rail 26. The free end 60 of angled body section 58 is flared so that no portion of its very end 62 can be accidentally struck by the flange of a car wheel moving from the long point rail element 22 toward spring wing rail element 50. An additional conventional spacer block 59 may, as in the case of spacer block 49, be advantageously positioned in assembly 10 but at the toe end between and connected to spring wing rail element 50 and to rigid wing rail element 40 to maintain their desired spacing and included angle of intersection. It should be noted that spring wing rail 50 at its angled body section 58 and at its free end 60 is not secured to base plate element 20 either by conventional plate clips or the like.

Thus, when the flange of a car wheel engages spring wing rail 50 at its free end 60 and causes it to move laterally so that a flangeway is provided between long point rail 22 and spring wing rail 50, rail 50 is stressed and flexed from the point of wheel engagement to where it is attached to spacer block 59. Spring wing rail element 50 is acting essentially as a cantilevered beam with a force applied at or close to its free end 60.

The railroad trackwork installation shown in FIG. 1 also typically includes a pair of conventional guard rail elements 64, 66 having flared ends which are positioned at turnout rail 14 and at mainline rail 18, each in spaced-apart relation to the adjacent rail by a distance that is slightly greater than the standard car wheel flange thickness, respectively, that function to "protect" rail 50 from lateral forces caused by possibly skewed car wheels and to assist in maintaining the gage of the track rail.

In addition, and as shown in FIG. 1, the improved railroad spring frog assembly 10 of this invention includes at least one hereinafter-described novel roller outrigger and ramp plate subassembly element 70 which, optionally but also advantageously, may be utilized in combination with one or more novel roller holddown subassemblies 72, each such subassembly 70 and 72 being rigidly connected in-part to spring wing rail 50 and in-part to base plate element 20. Subassemblies 70 and 72 function, during periods when a rail car wheel flange engages the free end 60 of spring wing rail 50 to cause lateral displacement of rail 50, to limit upwards vertical movement of the rail while permitting rail lateral movement, and to additionally do so in a manner which eliminates abrasion of the base plate, horn, and holddown elements of the assemblies.

Figure 2:
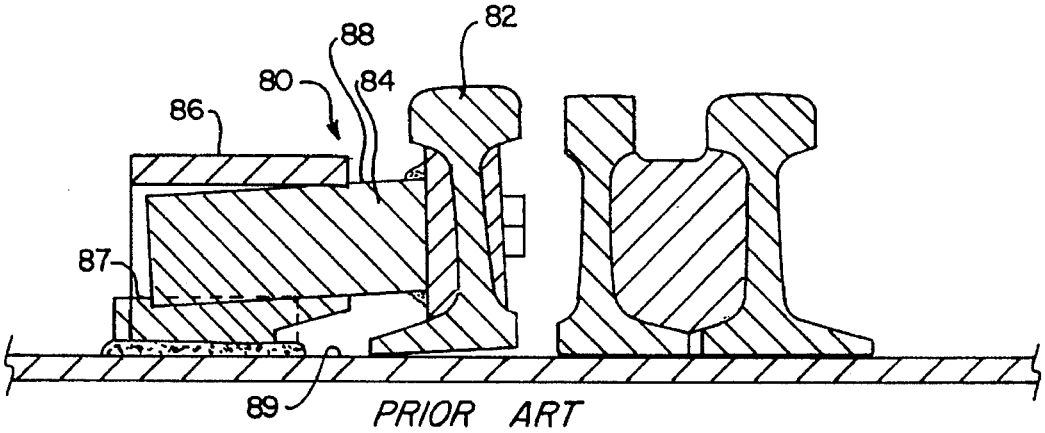
PRIOR ART FIG. 2
FIG. 2 is a sectioned elevational view of a conventional horn/horn-holddown assembly heretofore used in prior art railroad track spring frog installations.

Heretofore, state-of-the art spring-rail type railroad trackwork frog assemblies have utilized one or more conventional co-operating rail horn and horn holddown sub-assemblies of the type schematically referenced as 80 in FIG. 2 to vertically restrain a spring wing rail 82 during lateral rail movement caused by the rail's engagement with and displacement by a passing car wheel flange. Sub-assembly 80 is basically comprised of a horn element 84 that is rigidly and fixedly secured to spring wing rail 82 and a co-operating strap-like horn holddown 86 that slidably receives horn element 82.

As previously indicated, repeated lateral movement of a spring wing rail between its full closed and full open positions in response to the passing of rail car wheels through the conventional frog assembly installation causes excessive component wear due to metal abrading at least three different location. More specifically, and referring to FIG. 2, excessive wear has been noted at the upper surface region 87 of the riser block component of holddown 86, at the upper surface region 88 of the assembly horn element 84, and at the surface region 89 of the base plate upon which assembly 80 is mounted. The abrasion wear is principally caused by rail car wheel-originated flange forces being applied laterally to the side of the tread portion of the spring wing rail movable end causing the rail to become twisted or rotated about the laterally sliding rail base toe-like point of roll-over as it is moved when placing the frog assembly in an open condition. Such surface abrasion can be avoided totally by utilization of the combined roller outrigger and ramp plate frog element 70 detailed in FIGS. 3 and 4.

Figure 3:
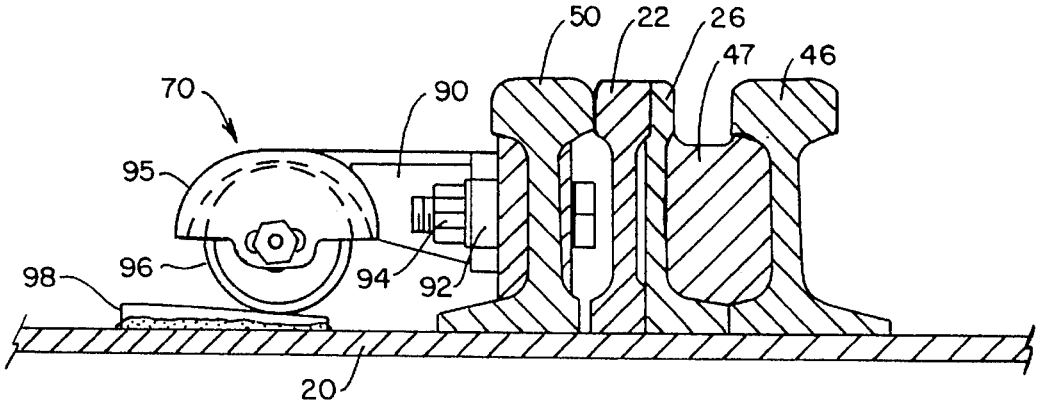
FIG. 3 is partially-sectioned elevation view taken at line 3—3 of FIG. 1 and illustrating a novel spring wing rail roller outrigger and combined riser plate element that is advantageously incorporated into the frog construction shown in FIG. 1.
Figure 4:
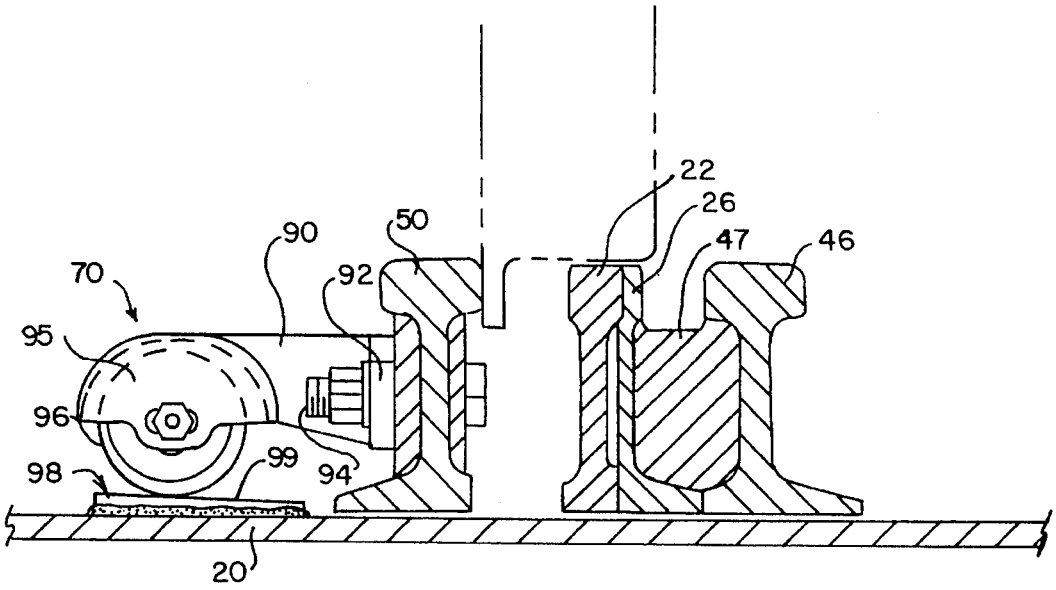
FIG. 4 is a view similar to FIG. 3 but illustrating the railroad track spring wing rail, and attached roller outrigger/riser plate element, in a "full open" condition as distinguished from the full closed condition of FIGS. 1 and 3.

As shown in FIGS. 3 and 4, roller outrigger and ramp plate assembly 70 is comprised of a forged outrigger arm 90, which is preferably made of a ductile iron, that has an integral base element 92 mounted to the web portion of spring wing rail 50 and rigidly secured in place by threaded fastener means 94. The integral housing portion 95 formed at the outboard end of outrigger arm element 90 partially contains, and rotatably supports, a roller wheel designated 96. Such roller wheel is preferably made of a forged and hardened metal and is supported by and co-operates with a ramp plate 98.

As best illustrated in FIG. 4, the upper surface of ramp plate 98, which ramp plate is usually welded in position to frog base plate element 20, has a sloped riser section 99 that is positioned intermediate two adjacent flat (non-rise) upper surface sections. In one actual embodiment of this invention ramp plate element 98 was provided with an intermediate sloped surface that measured approximately 5 inches in width by 1½ inches in length and had a rise of approximately 1/16 inch or 3/32 inch depending on assembly 70 location along the spring wing rail 50 from the free end 62. As previously indicated, when a rail car wheel flange moves the spring wing rail 50 toward a frog fully open condition, both outrigger arm 90 and the attached spring wing rail 50 are raised vertically thus taking the base undersurface of rail 50 out of contact with the upper surface of base plate element 20. The new "roll-over" point for rail 58 lies on the upper surface of ramp plate 98 vertically below the axis of roller wheel 96. Additionally, sloped riser section 99 of ramp plate 98 acts to assist in closing spring wing rail 5e against long point rail 22 after a car wheel flange has passed therebetween. This sloped riser section 99 also acts to resist excessive outward or lateral movement of spring rail 50 when a car wheel flange engages it.

In addition to the utilization of at least one roller outrigger assembly 70 in the improved railroad spring frog of this invention, I find it advantageous to include at least one roller holddown assembly 72 in order to provide a limit to any upwards vertical movement of spring wing rail 50 beyond that produced by the interaction of roller outrigger wheel element 96 and the sloped surface portion 99 of ramp plate 98 during lateral movement of spring wing rail 50 to a full open condition. It should be noted that assembly 70 does not provide a positive limit to that possible excess vertical movement.

Figure 5:
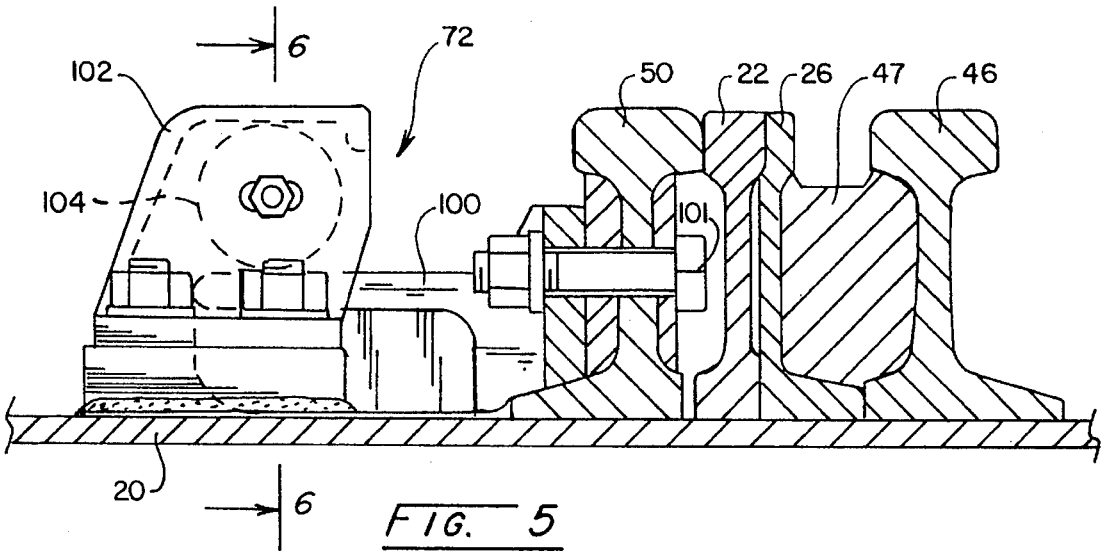
FIG. 5 is a partially-sectioned elevation view taken at line 5—5 of FIG. 1 and illustrating a spring wing rail roller holddown element which may be advantageously and additionally incorporated into the railroad track frog of FIG. 1.
Figure 6:
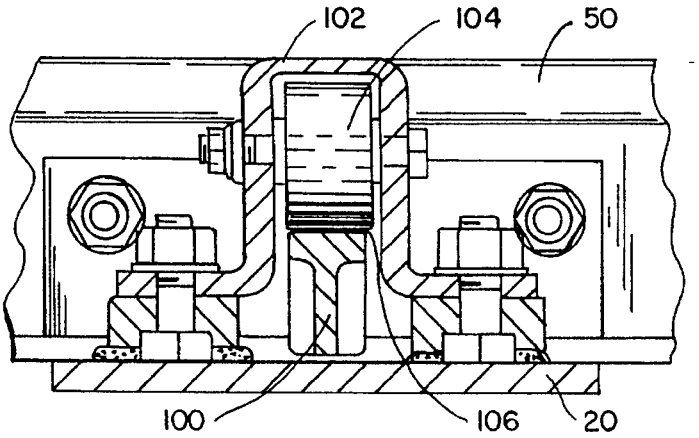
FIG. 6 is a partially-sectioned elevation view taken at line 6—6 of FIG. 5.

As shown in FIGS. 5 and 6, assembly 72 is basically comprised of a roller horn element 100 that is rigidly secured to the web portion of spring wing rail 50 by threaded bolt fasteners 101 and of a roller holddown element 102 that co-operates with horn element 100. Horn element and roller holddown element 102 are each preferably forged of a ductile iron material. Contained in strap-like subassembly 102, which subassembly is fastened to riser blocks that are welded to base plate 20, is a hardened and rotatable metallic roller wheel 104. The upper surface of roller horn 100 is preferably provided with a crown contour, and an initial gap or space 106 is provided between the upper surface of roller horn 100 and the lowest point of roller wheel 104 when spring wing rail 50 is in its full closed condition. The gap or space is preferably slightly greater in dimension that the amount of vertical rise incorporated into the ramp plate element 98 so that when spring wing rail is moved to its full open condition, vertically restrained roller wheel 104 functions to limit any significant further upward movement of roller horn element 00 and its attached spring wing rail.

From the foregoing it becomes apparent that substantial component wear associated with the conventional spring frog construction that utilizes sliding rail horn and horn holddown elements may be nearly totally avoided by utilizing the above-described roller outrigger and roller horn holddown subassemblies instead.

Other component shapes, sizes, and materials may be substituted for the component shapes, sizes, and materials described above to obtain the advantages of this invention and without departing from the claimed scope of the invention.

We claim as our invention:

1. In a railroad trackwork frog assembly having a relatively fixed rigid wing rail and a partially movable spring wing rail, in combination:

a base plate element;

a roller outrigger element fixedly attached to the spring wing rail; and a ramp plate element fixedly attached to the base plate element, said roller outrigger element and said ramp plate element co-operating to vertically elevate said spring wing rail when the spring wing rail is moved laterally relative to the rigid wing rail by an engaged rail car wheel flange.

2. The invention defined by claim 1 wherein said ramp plate element is provided with a sloped surface portion positioned intermediate two flat surface portions, said sloped surface portion having an elevational rise of approximately from 1/16 inch to 3/32 inch over a lateral distance of approximately 1½ inch.

3. The invention defined by claim 1 and further comprised of at least one roller holddown, said roller holddown comprising: a laterally-projecting horn element rigidly attached to the spring wing rail in spaced-apart relation to said roller outrigger and ramp plate elements, and a roller element that is vertically fixed relative to said base plate element and that is co-operably engaged with the upper surface of said horn element, said roller holddown limiting the upwards vertical movement of the spring wing rail when said spring wing rail and attached horn element are moved laterally relative to the fixed wing rail by an engaged rail car wheel flange.

4. In a railroad trackwork, a spring wing rail roller holddown assembly comprising:

a base plate element;

a horn element rigidly attached to the web of a spring wing rail; and a roller holddown element fixedly attached to said base plate element and having a roller wheel, said roller holddown assembly having an initial gap intermediate the contact surface of said roller wheel and the co-operating contact surface of said horn element to thereby limiting the upwards vertical movement of said horn element and attached spring wing rail relative to said roller holddown element and attached base plate element.

5. The invention defined by claim 4 wherein said initial gap is dimensionally in the range of approximately 1/16 inch to 3/32 inch.

* * * * *